United States Patent [19]

Lems et al.

[11] 4,077,313

[45] Mar. 7, 1978

[54] METHOD OF TENSIONING AND JOINING A FORMED STRAP LOOP ABOUT A PACKAGE

[75] Inventors: Peter Lems, Wilmette; Nelson Cheung, Arlington Heights, both of Ill.

[73] Assignee: Signode Corporation, Glenview, Ill.

[21] Appl. No.: 752,289

[22] Filed: Dec. 20, 1976

[51] Int. Cl.[2] ..... B65B 13/02

[52] U.S. Cl. ..... 100/2; 100/26

[58] Field of Search ..... 100/2, 6, 26, 29, 33 R, 100/33 PB; 53/198 B; 156/157

[56] References Cited

U.S. PATENT DOCUMENTS

| | | | |
|---|---|---|---|
| 1,357,883 | 11/1920 | McChesney | 100/2 |
| 3,420,158 | 1/1969 | Kobiella | 100/2 |
| 3,875,855 | 4/1975 | Clark | 100/2 |
| 3,946,659 | 3/1976 | Gutjahr | 100/26 |

*Primary Examiner*—Edward J. McCarthy
*Attorney, Agent, or Firm*—Dressler, Goldsmith, Clement, Gordon & Shore, Ltd.

[57] ABSTRACT

A method is disclosed for tensioning of a formed strap loop about a package and joining of the overlapping portions of the loop in a manner that improves the residual tension of the loop. The strap loop, in the region of the overlap, is twisted so that the sides of the strap in that region are displaced from the package surface and so that one of the edges of that region remains adjacent the package surface whereby the tensioned loop can be joined by friction fusion, formation of interlocking slits, or application of an independent seal without having to insert an anvil or bearing member between the package and the loop and thus increasing the residual tension. After the strap is restrained in the region where the strap free end overlaps a portion of the formed strap loop to prevent relative movement between the free end and overlapped portion, the package is encircled by the loop so that the strap is twisted in the balance of the loop relative to the restrained region. The loop may be tensioned before or after twisting. Regardless, in the twisted orientation, one of the two edges of the strap in the restrained region is adjacent the package while the other edge is spaced away from the package to expose, and provide a clearance area around, both sides of the overlapping strap portions in the region of restraint. A joint connection or seal is then made between the overlapping portions of the loop by joint-forming mechanisms in the clearance area. Finally, the trailing length, or standing portion, of strap is severed from the loop and the twisted strap is allowed to relax to a position flat against the package.

13 Claims, 10 Drawing Figures

12
15
15
16
16
13
14
18
16
12'

Fig. 2.
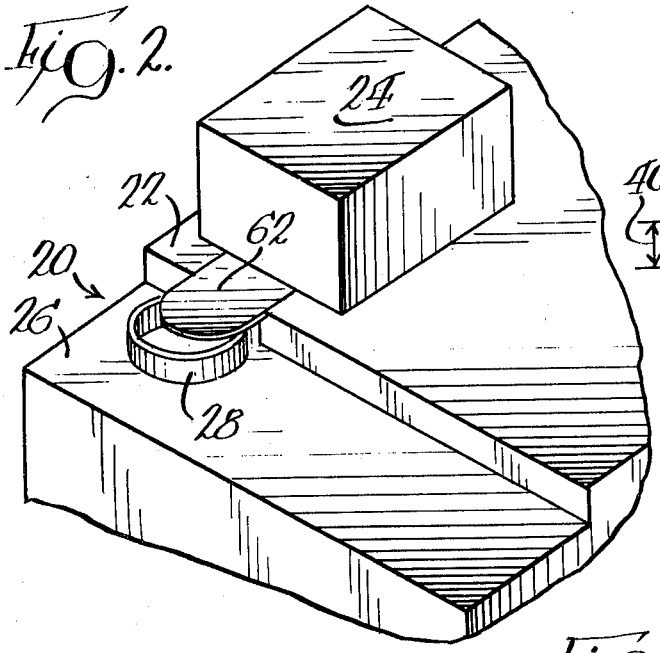
Fig. 4.
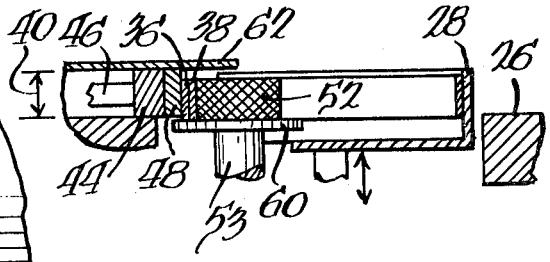
Fig. 3.
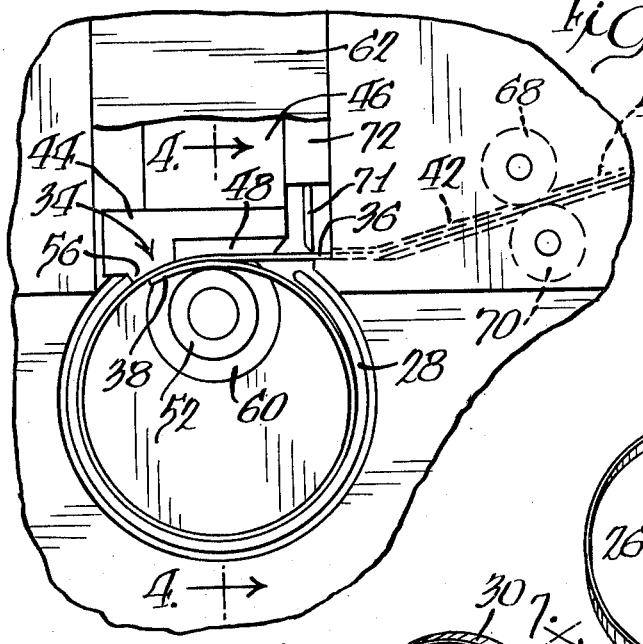
Fig. 5.
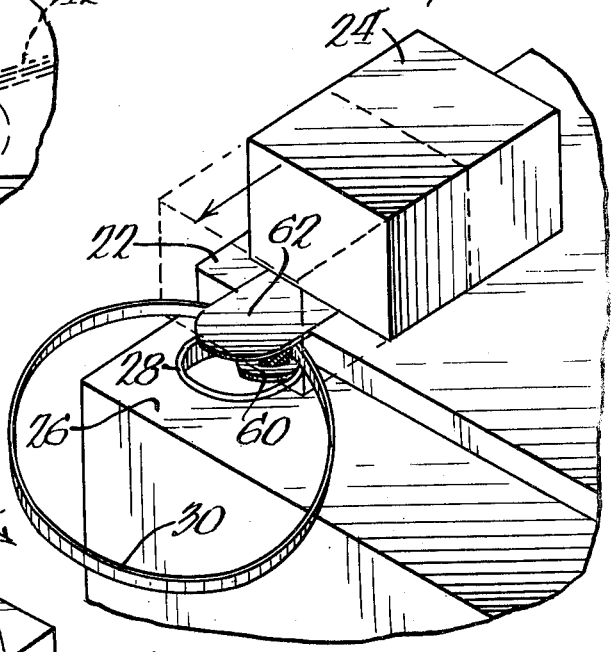
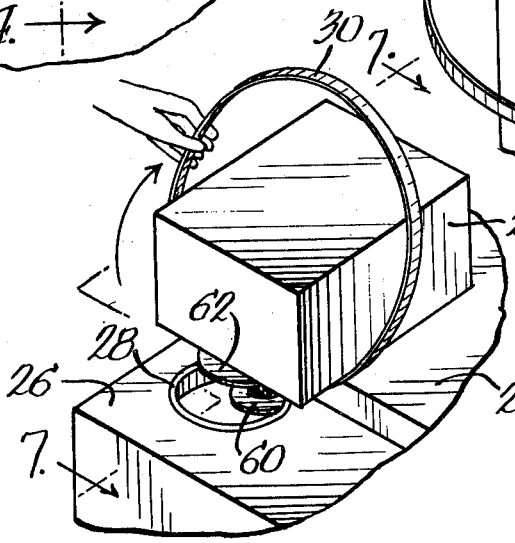
Fig. 6.

METHOD OF TENSIONING AND JOINING A FORMED STRAP LOOP ABOUT A PACKAGE

BACKGROUND OF THE INVENTION

This application is related to the concurrently filed Cheung application Ser. No. 752,011 entitled "Expanding Strap Loop Forming and Friction Fusion Machine."

In the past, Signode Corporation, the assignee of the entire interest of the present application, has developed several processes and machines for forming a strap loop about a package, tensioning the loop, and joining the overlapping portions of the tensioned loop.

Some strapping machines are portable and of the semi-automatic type. For example, the operator must first loop the strap about the package and then the machine is applied to tension, seal, and sever the loop. Other machines, such as the machine disclosed in the Kobiella U.S. Pat. No. 3,442,203, are of the completely automatic type, i.e., one which automatically feeds a thermoplastic strap around a package from a strap supply source, grips the leading end of the strap, withdraws the standing length of the strap to tension the strap loop, friction-fuses the overlapping portions of the loop, and severs the loop from the standing length of the strap. This type of automatic strapping machine has a relatively large, ring-like, rigid chute into which the package is inserted and in which the strap is fed to form a closed loop around the package.

Strapping machines are available today for joining the overlapping portions of a tensioned loop in a number of different ways. The overlapped loop portions may be secured with an independent seal which is placed around the overlapped strap portions and clamped or crimped thereto. A second way of joining the overlapped portions of a tensioned loop does not require an independent seal. Rather, with metal strap, notching jaw-type or punch-type mechanisms are forced against each side of the overlapped portions of the strap loop to cut a slit in, and to deform a portion of, the overlapped strap portions so that thereafter they may become nestably interlocked together. The third method is used to form the overlapping strap portions of a loop formed from plastic strap by positioning a heating assembly to cause interface melting between the portions so that both portions fuse together. A fourth method of joining overlapping strap portions of a loop can also be used on plastic strap or on plastic-coated metal strap and forms a friction-fused joint. The method for friction-fusing the overlapped portions of the strap loop requires that the overlapped portions of the loop be placed between an anvil and a movable weld head. The weld head is oscillated with a relatively small displacement at a relatively high frequency while it is in contact with the overlapping strap free end. This causes the strap free end to move back and forth against the overlapped portion of the strap and to generate heat by friction thereby effecting interface melting therebetween.

Present strapping machines which form any of these types of joints have a common drawback relating to the formation of the joint. In order to form these joints in the overlapped portions of the strap loop, an anvil or bearing member must be inserted between the package and the strap loop to provide a rigid bearing surface against which the overlapping strap portions are pressed. With machines that produce a slit-type joint or an independent crimped seal joint, such a bearing member may be an integral part of the notching or sealing jaw mechanism. Some types of machines also require that an anvil member be inserted between the package and the strap loop to effect proper tensioning prior to forming the joint. Regardless, any such anvil or bearing members prevent the strap loop from lying flat against the surface of the package at that point and therefore may introduce some slack into the loop when it is removed. However, owing to the flexibility of the strap, a tight loop can usually be obtained with large and/or slightly resilient packages. Unfortunately, though, with small packages and/or with rigid packages the amount of slack introduced into the strap loop by the inserted anvil or bearing member can be significant and can result in a loose strap loop when the anvil or bearing member is ultimately retracted from between the strap and the package. Accordingly, it would be desirable to provide a method and apparatus for tensioning and joining of the strap in a manner that does not require the insertion of an anvil member between the strap and the package.

SUMMARY OF THE INVENTION

The method of the present invention utilizes a novel concept of twisting a region of the overlapped portion of the strap loop so that one edge of the strap is positioned away from the surface of the package. Thus, a region of the overlapped portion of the loop is oriented with one edge of the strap nearer the package or center of the loop than the other edge. Preferably, the strap is twisted so that both edges of the strap in the region are aligned in the plane of the loop about the package (i.e., perpendicular to the adjacent surface of the package). This provides clearance in the region on each side of the strap for the joint forming and tensioning mechanisms and permits the joint to be formed without requiring that the mechanisms, or portions thereof, be inserted between the package and the strap.

The process of formation of the strap loop can be performed by hand or by machine in a variety of ways and is not part of the method of the present invention. In accordance with the preferred sequence of steps in the method of the present invention the strap free end and the overlapped portion of the formed loop are first restrained together and the package is placed over a portion of the expanded loop. The loop is then twisted substantially 90° about the restrained region of overlap and placed about the package in a vertical plane, after which the loop is tensioned to tighten it about the package. When the loop has been sufficiently tightened, the strap free end is connected or joined in the restrained region to an adjacent overlapping portion of the loop by appropriate means, such as by friction fusion, fusion effected with a heated member, application of an independent seal, or by formation of an interlocking slit-type joint. The joint is formed in the restrained region where the surfaces of the strap are substantially parallel to the plane of the loop around the package. This permits the joint forming mechanisms to be located on each side of the overlapping strap portions in the restrained region and thus allows the joint to be formed without requiring that an anvil or other portion of the joint mechanisms be inserted between the package and the strap. The completed loop can then be severed from the trailing length of strap. After the restraints are removed from around the region, the strap loop is relieved from its 90° twist and lies flat on the surface of the package.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same.

FIG. 2 is a partial perspective view of an embodiment of an apparatus for strapping a package according to the preferred method of the present invention;

FIG. 3 is an enlarged, partial, fragmentary top view of the strap loop forming, tensioning, and joining area of the apparatus of FIG. 2;

FIG. 4 is a cross-sectional view taken generally along the plane 4—4 of FIG. 3;

FIG. 5 is a partial perspective view similar to FIG. 2 showing an expanded strap loop;

FIG. 6 is a partial perspective view similar to FIG. 5 showing the expanded strap loop being located about the package;

DESCRIPTION OF THE PREFERRED EMBODIMENTS

Figure 1:
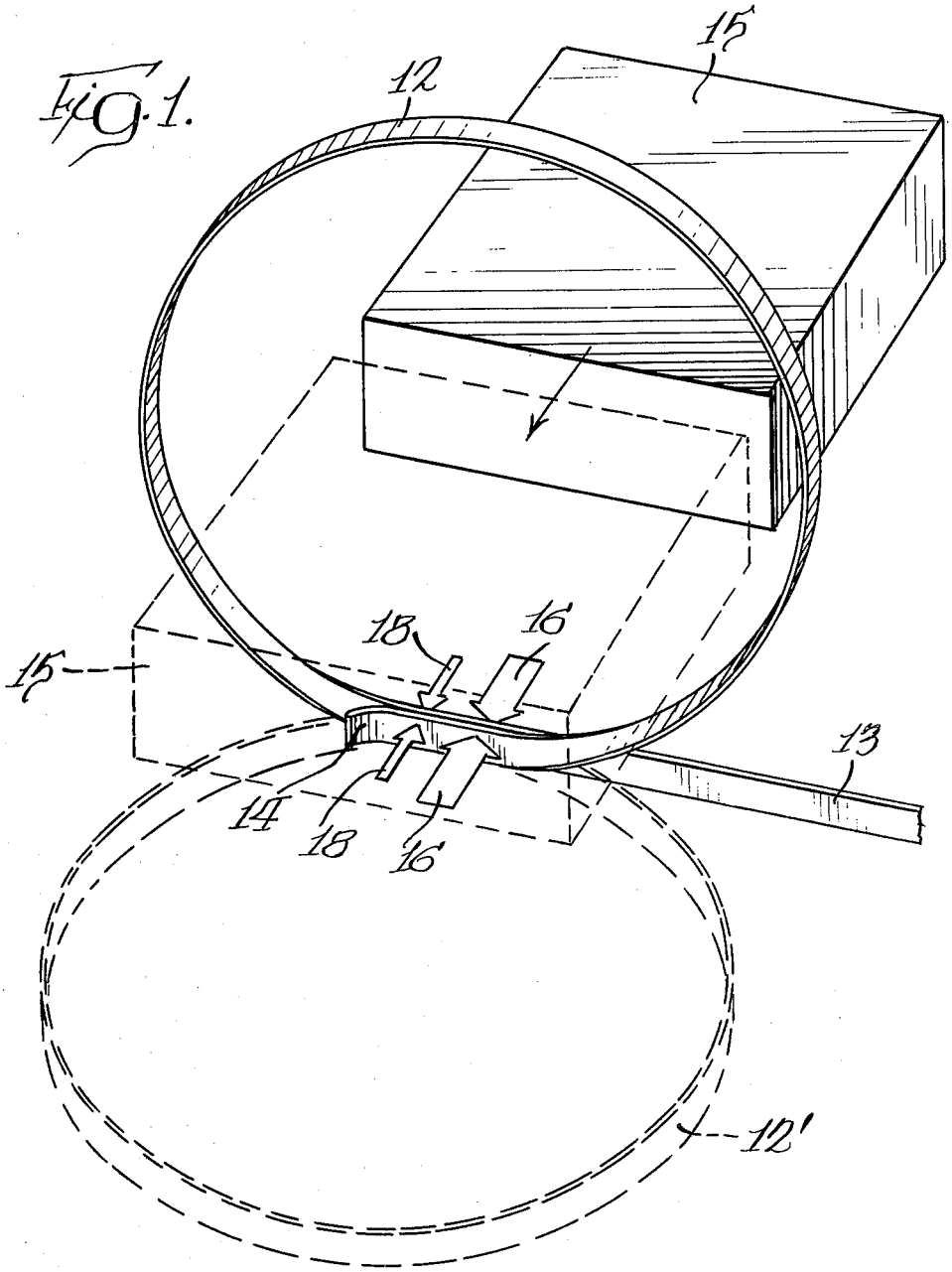
FIG. 1 is a simplified, partially schematic diagram illustrating the method of the present invention.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

For ease of description, the apparatus used for strapping a package according to the method of this invention will be described in normal operating position, and terms such as upper, lower, horizontal, etc., will be used with reference to this normal operating position. It will be understood, however, that the apparatus which is used to effect the method of this invention may be manufactured, stored, transported, sold and operated in orientation other than the normal operation position described.

The apparatus illustrated herein which may be used to effect the method of this invention has certain conventional drive mechanisms and control mechanisms which, though not fully illustrated or described, will be apparent to those having skill in the art and an understanding of the necessary functions of such drive mechanisms causing proper operation of the apparatus as will be explained.

The method of the present invention will be first generally described with reference to a simplified diagram illustrated in FIG. 1. Certain structures used to effect the various steps of the method of the present invention are schematically represented in FIG. 1 so that the method of the invention can be described without reference to more complicated structures of actual mechanisms that can be used. Following the basic description of the method of the invention with reference to FIG. 1, more detailed descriptions of the method, as performed by specific apparatus, will be given.

Referring now to FIG. 1, a strap loop 12 is shown formed from a standing length of strap 13 with the free end 14 overlapping a portion of the formed strap loop. The loop 12 can be formed in any particular plane with respect to a package 15 to be strapped. For example, the loop could have been formed originally in the horizontal plane as viewed in FIG. 1 and as illustrated by the dashed lines designated 12'. Then, the loop can be placed around the package 15, or the package 15 can be placed within the loop 12, or both the package 15 and the loop 12 can be moved to orient the loop 12 so that it encircles the package 15. The standing length of strap 13 is understood to be connected, at this point in the process, to some strap supply through an appropriate strap feeding mechanism (not illustrated).

It is to be understood that the loop can be initially formed by methods not part of this invention in which the strap free end 14 is not yet joined to the adjacent, overlapped portion of the loop. Consequently, some means is required to maintain the free end 14 in an orientation with respect to the balance of the loop 12 so that a loop does in fact exist. The strap free end 14 would not have to, at this step in the method, actually contact the overlapped portion of the loop. The strap free end 14 could be spaced away from the balance of the loop so long as the strap free end did "loop" back upon itself to completely encircle some central axis. To this end, the strap free end 14 could be restrained by hand or by some mechanical grasping, or jaw, mechanism. Preferably, however, the strap free end 14 is adjacent, and in contact with, the overlapped portion of the strap loop 12 and is maintained thereagainst, as by the schematically represented members 16 which can be moved towards and away from each other whereby the strap free end and the overlapping portion of the strap loop can be impressed therebetween.

If the loop is first formed horizontally (12') the members 16 are located to restrain the loop in a region of the overlap and then the loop 12' can be lifted up by hand to the vertical position, designated 12 in FIG. 1, in preparation for insertion of the package 15 therein. If the loop is so lifted by hand, the strap loop undergoes a relative twisting movement between the region of restraint (at members 16) and the balance of the loop. It is to be understood that the strap has two edges, in this case a bottom edge and a top edge, and that the strap comprises a free end and an overlapped portion, each of which necessarily has the same two edges. Thus, the twist, illustrated as approximately 90°, orients the top edge of the strap in the region of restraint closer to the bottom surface of the package 15 than the bottom edge of the strap. As a result, in that twisted orientation, the sides of the strap in the restrained region are not in contact with the bottom surface of the package. This permits access to the sides of the strap in that region for subsequent joint formation operations.

The twist in the strap, which is desired to expose the sides of the strap in the region of the overlap to joint forming mechanisms, can be created in the loop 12 by other means. For example, an empty strap loop, lying all in one plane, could first be restrained about the region of overlap between members 16 and then members 16 could be moved to create the twist. Subsequently, a package could be placed within the loop.

It should be noted that it is not necessary to create a full 90° twist within the loop 12. Some angle of twist less than 90° would prove satisfactory, depending on the particular restraint and joint forming structures used, so long as both sides of the strap in the region of overlap were spaced sufficiently far from the bottom of the package 15 to allow proper contact by, and operation of, the particular restraining and joint forming mechanisms.

Before the strap free end 14 is joined to an adjacent overlapped portion of the loop, the loop must be tensioned about the package. The loop can be tensioned, as by pulling on the standing length of strap 13, either before or after the twist has been created in the loop 12. With the strap free end 14 being held, either by hand or by some mechanical gripping member, the loop can then be tightened about the package by pulling on the standing length of strap 13, either by hand or with some suitable conventional mechanical strap tensioning device. If the loop should be tensioned about the package before the loop is twisted, then a suitable mechanism would have to be used to pry the overlap region of the loop away from the package into the twisted configuration to allow subsequent restraint of the region in the twisted orientation. Preferably, however, the twist is introduced into the loop before tensioning. In that case, the loop is tensioned while the region of overlap is held in the twisted position (as by members 16).

With the strap end 14 restrained from movement during tensioning, the strap in the loop must necessarily slide past the strap end 14. Alternatively, if the standing length 13 were restrained from movement during tensioning, the strap free end 14 must necessarily slide past the balance of the loop. In either case, it is necessary for the loop to be restrained in the region of the overlap to maintain the 90° twist in the loop while, at the same time, permitting one of the overlapping portions of strap to slide. This can be accomplished by providing a smooth surface on at least one of the members 16. Other ways of meeting this requirment will be fully discussed hereinafter in the descriptions of specific embodiments of apparatus for effecting the method of the invention.

After the loop tensioning, with the loop maintained in the twisted orientation to expose both sides surfaces of the loop in the region of overlap, mechanisms 18 can be introduced adjacent the strap in the region to form the joint between the free end 14 and an adjacent overlapped portion of the loop. Such joint forming mechanisms 18 can be those that form a friction fusion joint, apply an independent seal, or form an interlocking slit joint. Preferably, however, such joint forming mechanisms would be physically incorporated within the particular members 16 to keep the twist region as small as possible. Description of restraining members which incorporate, or simultaneously function as, joint forming members will be presented hereinafter.

Thus, it is seen that the creation of the twist in the loop 12 allows restraining mechanisms and joint forming mechanisms to be applied to the side surfaces of the strap in the region of overlap without requiring that a portion of the restraining or joint forming member (or any other anvil-type member) be inserted between the strap loop 12 and the bottom of the package 15. Thus, the strap can be placed around the package and ultimately tensioned and sealed without the introduction of the slack in the loop which would otherwise be created by such mechanisms.

The method in accordance with the present invention is illustrated as being performed by a particular apparatus 20 in FIGS. 2 through 7. In general, as shown in FIG. 2, the apparatus 20 has a package support surface 22 for supporting a package and a lower surface or shoulder 26 stepped below the elevation of the package support surface 22. Preferably, the apparatus 20 is of a size suitable for being placed on a work table or desk and is advantageously used to strap rectangular parallelpiped-shaped packages having dimensions of between 5 and 40 inches on each side. However, the method of the present invention and the apparatus 20 can accommodate much larger or smaller packages, as well as packages of different shapes.

OUTLINE OF THE MAJOR STEPS OF THE STRAPPING SEQUENCE

To aid in understanding the details of the method of the present invention, a brief outline of the method or process of tensioning and securing a strap loop about a package with the apparatus 20 will be presented.

Figure 7:
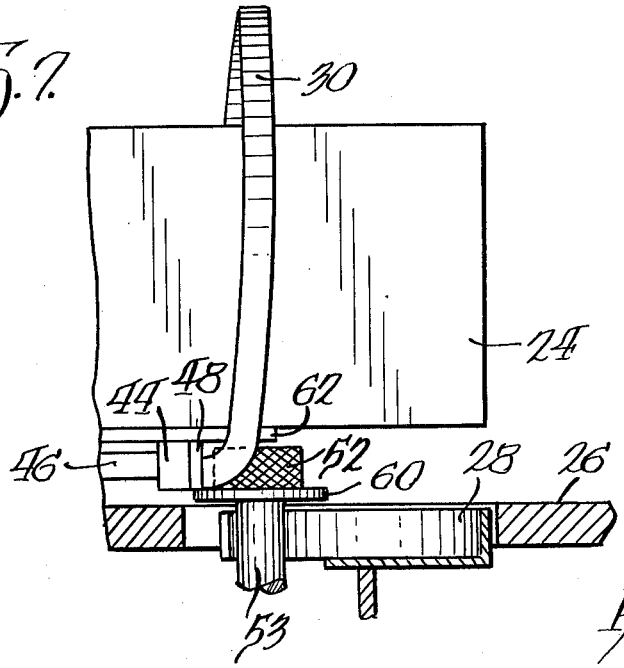
FIG. 7 is a cross-sectional view taken generally along the plane 7—7 of FIG. 6.

As illustrated in FIG. 2, a package 24 is initially placed upon the package support surface 22 near shoulder 26. A cylindrical cup 28 is raised from a position below the surface of shoulder 26 to an elevated position above the surface of shoulder 26. By a novel means, as will be described in detail hereinafter a length of strap is fed into the cup to form a primary strap loop. The cup 28 is then lowered to a position below the surface of shoulder 26 while the loop is maintained at the higher elevation where it is then expanded to a predetermined larger diameter loop 30 as illustrated in FIG. 5. Next, the package 24 is slid forward to overhang shoulder 26 and the operator then places the expanded loop 30 about the package 24 as illustrated in FIGS. 6 and 7. The strap is tensioned to draw the loop tight about the package and the entire process is completed when the tensioned loop is friction fusion welded to form a connection and the strap severed from the strap supply.

The specific features of the apparatus 20 used to accomplish the above-described package strapping process are fully set forth in the aforementioned concurrently filed Cheung application Ser. No. 752,011 entitled "Expanding Strap Loop Forming and Friction Fusion Machine" and attention is directed thereto. The major process steps of the instant method invention are performed by the apparatus 20 and involve (1) strap loop formation; (2) strap feeding and tensioning; (3) strap loop joint formation; and (4) strap severance. The basic features and mechanisms of the apparatus 20, insofar as they relate to these steps, will also be fully described here to provide a basis for a subsequent description of an alternate embodiment of an apparatus for effecting these steps as well as for the appended method claims.

STRAP LOOP FORMATION

In the illustrated embodiment of the apparatus a primary strap loop is first automatically formed and is subsequently expanded to a larger size. A mechanism for forming the primary strap loop is most clearly shown in FIG. 3.

By a strap feed mechanism described hereinafter, the strap is fed into a guide means. A circular band member, or cup 28, provides a circular guide means for forming the primary strap loop. Cup 28 is a substantially cylindrical member and may or may not have open ends. In the preferred embodiment illustrated, cup 28 has a partially closed bottom and an open top. A portion of the vertical cylindrical wall of the cup is cut away to form a relatively large opening or slot 34 for receiving a length of strap 36. The cup 28 guides the strap free end 38 in a closed arcuate path whereby the free end 38 is directed back upon the length of strap 36 to form the initial primary strap loop with the free end of the strap overlapping a portion of the formed strap loop.

The cup 28 is movable between an upper, or raised position and a lowered position by suitable mechanisms and controls, such as those described in the aformentioned Cheung application Ser. No. 752,011 entitled "Expanding Strap Loop Forming and Friction Fusion Machine."

The length of strap 36 is oriented with its side surfaces perpendicular to the plane of the package support surface 22 and is guided beneath the package support surface 22 in a strap transport zone 40 which lies between the package support surface 22 and the plane of shoulder 26 (as illustrated in FIG. 4). The strap transport zone 40 has a thickness substantially equal to the width of the length of strap 36 and is essentially a stratum in which the length of strap 36 is fed, guided, formed into a primary loop, expanded into a larger loop, tensioned, friction welded and severed. In the raised position (as illustrated in FIG. 2) the cup 28 lies in the strap transport zone 40. In the lowered position (as illustrated in FIG. 5), the cup 28 lies below the strap transport zone 40. The length of strap 36 is guided within the strap transport zone 40 by appropriate guideways 52 as illustrated by dashed lines in FIG. 3. The strap is also fed forward and tensioned rearward through the guideways 42 in zone 40 by appropriate traction drive means as will be described hereinafter.

During loop formation, the strap feed end 38 is (1) guided into the cup slot 34, (2) maintained within the cup 28 by upper and lower guides, and (3) restrained above cup 28 during lowering of cup 28 and subsequent expansion of the loop. These guides and strap restraining means will be described with reference to FIGS. 2 and 4. Adjacent slot 34 is an anvil 44 which is mounted on movable slide 46. A portion of anvil 44 adjacent the length of strap 36 has a smooth-surface polyurethane pad 48 secured thereto for guiding and contacting length of strap 36 as will be described hereinafter. Opposite the polyurethane pad 48 is a cylindrical member, or weld head 52, which uniquely serves two functions: (1) gripping the strap free end 38 and (2) welding the free end to the overlapped portion of the loop. The welding function will be described later. At this point, just the gripping or restraining feature of the weld head will be discussed. The weld head 52 is mounted on shaft 53 and is a substantially cylindrical member having a rough, peripheral gripping surface adapted for contacting side of the strap free end 38. Both the weld head 52 and the anvil 44 lie in the strap transport zone 40 as illustrated in FIG. 3.

The anvil 44 is movable, by appropriate drive means, within the transport zone 40 in a horizontal plane towards and away from the weld head 52. An appropriate drive means is disclosed in the aforementioned Cheung application Ser. No. 752,011 entitled "Expanding Strap Loop and Friction Fusion Machine." When the cup 28 is in the raised position as illustrated in FIGS. 2 and 3, the anvil 44 can be moved towards the weld head 52 to a position spaced away from the weld head where a portion of the anvil 44 contacts the cup 28 at abutment surface 56 and remains biased thereagainst. In this position there is sufficient clearance between the weld head and the polyurethane pad 48 to allow the length of strap 36 and the overlapping free end 38 to lie therebetween. When the cup 38 is lowered below the surface of shoulder 26, the anvil 44, being biased towards the weld head 52, moves toward the weld head 52 to bring the polyurethane pad 48 into contact with the length of strap 36 lying therebetween to restrain the overlapping strap free end 38 from movement.

Referring now to FIGS. 3 and 4, the detailed formation of the primary strap loop will now be described. First, the free end 38 of a length of strap 36 is fed forward in the strap transport zone 40 between the strap transport guideways 42 and through aperture 34 of cup 28. The strap free end 38 is guided by polyurethane pad 48 and a portion of anvil 44 as it enters the interior of cup 28. The strap free end 38 is guided by the interior surface of cup 28 in a closed arcuate path to form an initial primary loop with the free end 38 overlapping a portion of the loop between the anvil 44 and the weld head 52. By suitable control means, the feeding of the strap length 36 is terminated when the primary loop has been formed essentially as illustrated in FIG. 3.

It is desirable during the primary loop formation stage, as well as during subsequent tensioning and welding stages, to maintain the overlapped portion of the strap length 36 and the free end 38 in the elevation of the strap transport zone 49. To this end, appropriate upper and lower guides are provided. A flange 60 is provided in the lower end of the weld head 52 for keeping the overlapped portion of the strap length 36 and strap free end 38 from running below the weld head 52. A slide cover 62 is secured to, and movable with, slide 46 above the strap transport zone 40 to prevent the overlapped portion of the length of strap 36 and the strap free end 38 from riding above the weld head 52 and the polyurethane pad 48.

After the primary strap loop has been formed, the cup 28 must be lowered from its elevated position in the strap transport zone 40 to a second position below the strap transport zone 40. As the cup is lowered, the formed primary strap loop does *not* ride in the cup 28 to to the lowered position, but rather slides out of the cup and remains at the upper position. This is due to the combination of the relatively small diameter of the cup 28, the stiffness of the strap, the low coefficient of friction between the strap and the cup, and the fact that the strap length 36 is supported on its bottom edge in the strap transport zone guides 42. Consequently, when the cup 28 is lowered, the formed primary strap loop is maintained at the elevation of the strap transport zone 40 above the top surface of the shoulder 26.

After the cup 28 is completely lowered away from the primary strap loop, any tendency of the loop to uncoil or unwind is resisted. Owing to the proximity of the weld head 52 and the polyurethane pad 48 on opposite sides of the overlapping strap portions of the loop, the loop is not able to unwind and is thus maintained in a loop.

A novel method is used to expand the formed primary strap loop to a larger loop of predetermined diameter. With the cup 28 in the lowered position as illustrated in FIG. 4, slide cover 62, anvil 44 and polyurethane pad 48 are moved closer toward weld head 52 by slide 46 under the influence of a biasing mechanism (not illustrated). Anvil 44 is moved forward to force polyurethane pad 48 against the strap loop in a region where the strap free end 38 overlaps the overlapped portion of the loop formed by the length of strap 36. The polyurethane pad 48 then contacts a side of the length of strap 36 to force both the length of strap 36 and the overlapping strap free end 38 against weld head 52. By suitable biasing controls (e.g., as disclosed in the aforementioned Cheung application Ser. No. 752,011 entitled "Expanding Strap Loop Forming and Friction Fusion Machine"), the polyurethate pad 48 is maintained against the loop with a relatively small amount of force such that the strap free end 38 is restrained from moving by the roughened peripheral gripping surface on the weld head 52. However, the force is low enough (about 2 pounds) to permit the overlapped length of strap 36 to slide forward between the strap free end 38 and the smooth-surfaced polyurethane pad 48 when the length of strap 36 is fed to expand the loop. Preferably, during the expansion of the primary strap loop, the surface of shoulder 26 provides the support for the bottom of the strap loop as it expands.

After the loop has been expanded to the predetermined larger diameter, the strap feeding is terminated and the pad 48 is continued to be maintained against the strap to provide, in the region of the overlap, a restraint against relative movement between the free end 38 and the overlapped length of strap 36 during the subsequent step of placing the loop about the package. In that subsequent step, the operator first moves the package 24 forward over the region of the overlap as necessary, grasps a portion of the loop 30, and moves the loop to a substantially vertical plane around the package. In the process, the loop is simultaneously twisted approximately 90° so that the plane of the strap in the region of the overlap is lying substantially in the plane of the balance of the loop about the package. The loop 30 is then tensioned and tightened about the package 24.

The details of the mechanism for applying tension to the strap will be discussed later. It is first necessary to describe the action of the polyurethane pad 48 and the weld head 52 during the tensioning process. At the beginning of the tensioning step, the strap loop 30 is disposed about the package 24 as illustrated in FIG. 6. At this time, the cup 28 is in the lowered position below the surface of the shoulder 26. The standing length of strap 36 is then pulled, or withdrawn, to tighten the loop. During tensioning, a tensile force is transmitted along the length of the strap 36 which is considerably higher than the small compressive force which exists in the portion of the strap between the strap feed mechanism and the polyurethane pad 48 as the strap is being fed to form the expanded loop. Consequently, during tensioning the higher force occurring in the strap would tend to pull the strap free end 38 from its restrained engagement against weld head 52. To overcome this possibility, the polyurethane pad 48 is forced against the weld head 52. In the embodiment of the apparatus 20 illustrated, it has been found that a force of about 30 to 40 pounds is sufficient to maintain the strap free end 38 between the polyurethane pad 48 and the weld head 52 as the overlapped length of strap 36 is tensioned. Typically, the strap loop is tensioned to about 10 or 15 pounds.

During the tensioning process, the upper edge of the strap, in the region of the strap overlap between the polyurethane pad 48 and the weld head 52, is nearer the bottom surface of the package 24 (and also nearer the center of the loop) than is the bottom edge of the strap. Preferably, the strap loop 30 is maintained in the 90° twist orientation illustrated in FIG. 7 such that both the upper and lower edges of the strap in the region between the polyurethane pad 48 and the weld head 52 are located in the plane of the loop as the loop is tensioned about the package 24. Although the sliding surface of polyurethane pad 48 and the opposed peripheral gripping surface of weld head 52 are shown in FIG. 7 as being perpendicular to the slide cover 62 and to the bottom of the package 24, such orientation is not necessarily required. The surfaces on both the polyurethane pad 48 and the weld head 52 could be angled with respect to the plane of the strap loop 30 about the package 24.

During the tensioning process, slide cover 62 lies between the bottom surface of package 24 and the strap loop 30. With some types of soft packages and at certain high tension levels, the slide cover 62 serves to prevent the loop 30 from pulling out of engagement from between the polyurethane pad 48 and the weld head 52. After tensioning, when the slide cover 62 is removed from between the package 24 and the loop 30 as will be described hereinafter, a small amount of slack is thus present in the tightened loop. However, due to the elasticity of the plastic strap and due to the expansion of the compressed package 24, a tight loop is nevertheless achieved when the slide cover 62 is removed. Additionally, the slide cover 62 can be made relatively thin (in the vertical direction as viewed in FIG. 30) and can be made relatively narrow with respect to the package width (as viewed in the horizontal direction in FIG. 4) to minimize the amount of slack formation. Further, with certain types of packages (such as those having rather rigid and incompressible surfaces), and with low loop tensions, the slide cover 62 can be eliminated altogether. This is because, at low tension levels, the strap loop has less of a tendency to be pulled out of engagement from between the polyurethane pad 48 and the weld head 52. Further, the relative incompressibility of such a package would prevent the strap loop 30 from sinking into the package and pulling away from the polyurethane pad 48 and the weld head 52.

STRAP FEEDING AND TENSIONING

The strap is both fed and tensioned by one traction wheel assembly. A traction wheel 68 and adjacent idler wheel 70 are mounted for horizontal rotation below the package support surface 22 and are illustrated in dashed lines in FIG. 3. The idler wheel 70 is preferably spring-biased against the traction wheel 68. The strap 36 is threaded in the guideways 42 and between the traction and idler wheels 68 and 70, respectively. Traction wheel 68 is shaft mounted and is rotatably drivable in either direction by an appropriate drive means. The drive means rotates the traction wheel 68 first clockwise (as viewed in FIG. 3) to feed the strap to form the loop and then counterclockwise (as viewed in FIG. 3) to tension the loop.

A bulk supply of strap is preferably wound on a conventional self-supporting spool (not shown) which can be placed near the apparatus 20 and which rotates to deliver strap in response to the feed force of the traction wheel 68 pulling on the strap.

By suitable control means, the traction wheel is rotated just enough to cause the length of strap 36 to form a primary strap loop within cup 28 with the strap free end 38 overlapping a portion of the loop (the final orientation being illustrated in FIG. 3). After formation of the primary strap loop in the cup 28, the cup 28 is lowered away from the loop and the traction wheel 58 is driven to expand the loop to a predetermined size. The cup 28 can be lowered quite rapidly so that it is not necessary to terminate the strap feeding process while the cup 28 is being lowered. Thus, the strap can be continuously fed without interruption until the desired expanded loop diameter is achieved.

After the expanded loop is placed around the package, the traction wheel is rotated in the opposite direction to tension the loop. The tensioning process is terminated when the desired level of loop tension is sensed by a suitable tension sensing control means.

STRAP LOOP JOINT FORMATION

The method and mechanisms for connecting the strap free end 38 to the overlapped portion of the length of strap 36 will now be described. With plastic strap, or plastic-coated metal strap, a welded or friction-fused joint can be achieved by heating the overlapped region of the loop.

In the preferred embodiment, the fusion heat is generated by rapidly moving the strap free end 38 against the overlapped portion of the length of strap 36 to generate heat by friction and effect interface melting therebetween. More particularly, this is accomplished by oscillating the weld head 52 with a relatively small angular rotation at a sufficiently high frequency. Weld head 52 is rotatably oscillated about the shaft 53 so that its peripheral gripping surface, being engaged with a side of the strap free end 38, causes the strap free end 38 to be moved back and forth with respect to the stationary overlapped portion of the length of strap 36. Typically, the frequency of oscillation is between about 50 to 100 hertz, the total amplitude of circumferential rotation of the weld head gripping surface is about 0.15 inch, and the oscillation period lasts from between 0.75 to 1.0 seconds. In order to insure an adequate weld, the polyurethane pad 48 is pressed against the overlapped portion of the length of strap 36 with a higher force than is used during the tensioning process. Typically, a force of about 100 pounds is impressed against the strap during the friction-fusion process.

The weld head 52 is driven in the oscillatory mode by appropriate drive means and oscillating drive transmission (not shown) which are well known and commercially used in present friction-fusion strapping machines. A description of such mechanisms can be found in the U.S. patent to Ericsson, U.S. Pat. No. 3,586,572.

After the friction-fusion joint has been completed, the cup 28 is still maintained in the lowered position below the surface of shoulder 26 while the weld head 52 and the polyurethane pad 48 are maintained in compressive engagement on the strap loop so that the strap loop can be severed from a standing portion of the strap length 36 as will be described in detail in the next section.

With metal strap, other types of joints could be created through the use of additional, conventional joint forming mechanisms (not illustrated). Such other joints may be, for example, of the independent seal type or of the interlocking slit type. Descriptions of such seals and sealing mechanisms can be found in the U.S. patents to Crosby U.S. Pat. No. 2,710,434; to Crosby et al. U.S. Pat. No. 2,801,558; and to Beach U.S. Pat. No. 3,303,541. These mechanisms could be modified as necessary for use in place of, or in conjunction with, the weld head 52 and anvil 44 in the clearance area around the region of strap restraint where the surfaces of the strap lie in the plane of the loop around the package.

STRAP SEVERANCE

After the loop has been connected by the friction-fused weld, the standing portion of the strap is severed from the loop by cutter blade 71 as best illustrated in FIG. 3. The cutter blade 71 is fixed in a slide block 72 which is slidably mounted for movement toward and away from strap 36. The cutter blade 71 is moved by a suitable linkage and drive means such as described in the aforementioned Cheung application Ser. No. 752,011 entitled "Expanding Strap Loop Forming and Friction Fusion Machine."

After the strap has been severed, the anvil slide 46 is moved away from the weld head 52 to retract the anvil 44 and the slide cover 62. With the anvil 44 retracted, the fused portion of the strap loop adjacent the weld head 52 is relieved from its 90° twist configuration with respect to the balance of the loop and lies flat along the bottom surface of the package. Since the slide cover 62 is also retracted, the tensioned strap loop shrinks further, under influence of its elasticity, to fit tight around a portion of the surface of the package that was previously in contact with the slide cover 62. The strapped package can then be removed from the apparatus.

Figure 8:
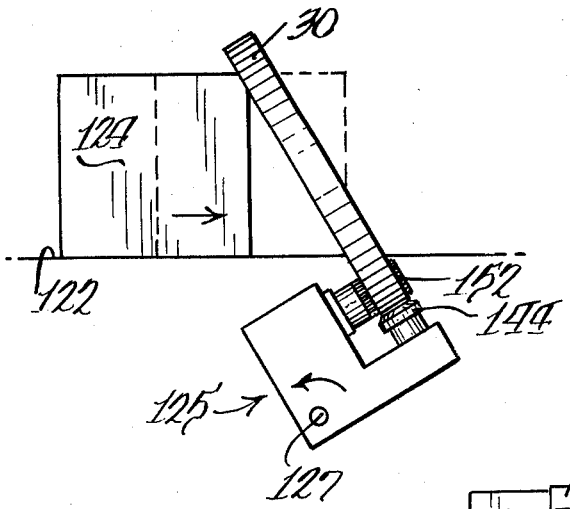
FIG. 8 is a view similar to FIG. 7, but simplified and showing the strap joining mechanisms of a second embodiment of an apparatus for strapping a package according to the method of the present invention.
Figure 10:
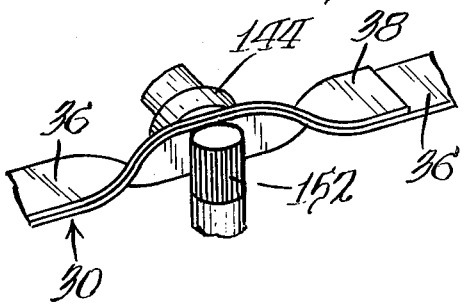
FIG. 10 is an enlarged perspective view of the twisted region of the strap restrained in a portion of the strap joining mechanisms.
Figure 9:
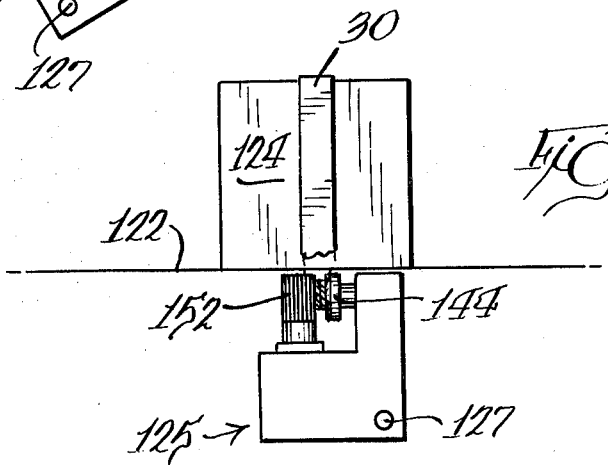
FIG. 9 is a view similar to FIG. 8 but showing the strap joining mechanisms moved to twist the strap loop according to the method of the present invention.

FIGS. 8 through 10 illustrate an alternate embodiment of the strap loop tensioning and joining mechanism of an apparatus for effecting the method of the present invention. The embodiment is depicted in a simplified form wherein many of the structural details of the apparatus are identical to those of the above-described apparatus 20 illustrated in FIGS. 2 through 7 and, these have been eliminated in FIGS. 8 through 10 for clarity.

A package support surface 122 is provided to support a package 124. Below the package support surface 122 is provided a pivotable unit 125. The pivotable unit 125 is comprised of a weld head 152 and an anvil 144 which together operate to impress a portion of a strap loop 30 therebetween in the same manner as the weld 52 and anvil 44 of the embodiment previously described and illustrated in FIGS. 2 through 7. The pivotable unit 125 containing the anvil and weld head is mounted for rotation about pin 127 from a first loop forming position illustrated in FIG. 8 to a second loop tensioning and joint forming position illustrated in FIG. 9. Other mechanisms, such as a primary strap loop forming cup, traction wheel drive mechanism, and strap severing cutter blade mechanism are also mounted on the pivotable unit 125 but are not illustrated in the figures. Such additional mechanisms function analogously to those mechanisms previously described and illustrated in FIGS. 2 through 7.

The embodiment illustrated in FIGS. 8 through 10 offer an advantage compared to the embodiment illustrated in FIGS. 2 through 7 in that the operator need not grasp the expanded loop 30 and twist it about the package to be tied. Specifically, the primary strap loop is formed with the pivotable unit 125 oriented at the angle illustrated in FIG. 8 below the package support surface 122. When the primary strap loop has been formed in a loop forming cup (not illustrated, but similar to cup 28 illustrated in FIGS. 2 through 7), the cup is moved away from the formed primary strap loop so that the loop may be expanded as illustrated in FIG. 8. With sufficiently rigid strap, the strap will form a large loop 30 which, under the influence of gravity, will deform only slightly to an elliptical shape. However, the minor axis of the ellipse will be at least large enough to extend over the top of a package 124 located to one side of the loop. Then the package 124 may be moved by hand, or automatically by conveyor, closer to the pivotable unit 125 so that the outer part of the loop 30 lies on the middle of the package as illustrated by dashed lines in FIG. 8. At the same time, by appropriate drive means (not illustrated), the pivotable unit 125 can be rotated to the vertical position shown in FIG. 9 below package 124. In this process, the loop 30 is simultaneously twisted so that the plane of the strap in the region of the overlap is aligned substantially in the plane of the balance of the loop about the package. The twist in the loop 30 is more clearly illustrated in FIG. 10 which shows the strap free end 38 and an overlapped portion of the strap 36 restrained in a region of the overlap between the anvil 144 and weld head 152.

With those types of packages having a rather rigid and incompressible surface and/or with low loop tensions, the pivotable unit 125 can be rotated such that the tops of the weld head 152 and anvil 144 are adjacent, and almost contacting, the bottom of the package 124. Obviously, in order that this can occur, the package support surface 122 must have a channel or slot to allow for the movement of the weld head and anvil therein. The bottom of the package 124 would be supported by surface 122 on either side of this channel or slot. Then, when the loop has been tensioned, joined and severed from the trailing portion of strap, the anvil 144 can be moved away from weld head 152 thereby freeing the strap loop so that the loop can twist back against the bottom surface of the package 124, after which the package can be removed from the package support surface 122.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

We claim:

1. A method of tensioning and securing a strap loop about a package, said strap loop formed between a free end of a length of strap and a standing portion of said length of strap with a portion of the strap loop overlapped by said free end, said method comprising:

restraining said free end and an overlapped portion of the loop in an orientation to maintain a region of overlap;

effecting relative movement between said package and said strap loop to locate the loop about said package;

effecting relative twisting movement of the strap between said region and the balance of the loop to orient one edge of the strap in said region nearer the center of the loop than the other edge;

tensioning said length of strap to tighten the loop about the package; and joining said free end and an overlapped portion in said region.

2. The method of claim 1 wherein the step of effecting relative twisting movement of the strap includes orienting said one edge of the strap in said region nearer a surface of said package than the other edge of the strap in said region.

3. The method of claim 2 wherein the step of effecting relative twisting movement of the strap includes substantially aligning both edges of the strap in said region in the plane of the loop about said package.

4. The method of claim 1 wherein the step of effecting relative twisting movement of the strap includes orienting said one edge of the strap in said region adjacent to, and in contact with, a surface of said package and orienting said other edge of the strap away from said surface.

5. The method of claim 1 wherein the step of effecting relative movement between said package and said strap loop includes inserting said package into said loop.

6. The method of claim 1 wherein said package remains stationary and wherein the step of effecting relative movement between said package and said strap loop and the step of effecting relative twisting movement of the strap are performed substantially simultaneously whereby said balance of the loop is moved to encircle said package.

7. The method of claim 1 wherein the step of restraining said free end of the strap includes pressing said free end and an overlapped portion of the strap loop in said region between a rough-surfaced member contacting a side of said free end and a smooth-surfaced member contacting a side of the overlapped portion of the strap loop.

8. The method of claim 7 wherein the step of effecting relative movement between said package and said strap loop includes inserting said package into said loop and wherein the step of effecting relative twisting movement of the strap includes rotating said rough-surfaced member and said smooth-surfaced member together through an arc adjacent said package whereby said region is twisted substantially 90° with respect to the balance of the loop and both edges of the strap in the said region are aligned in the plane of the loop about said package.

9. The method of claim 7 wherein said strap is one of non-metallic and metallic with a non-metallic coating and said step of joining includes friction welding said strap by oscillating said rough-surfaced member at a sufficiently high frequency to fuse said free end of the strap to an overlapped portion of the loop.

10. A method of tensioning and securing a strap loop about a package, said strap loop formed between a free end of a length of strap and a standing portion of said length of strap with a portion of the strap loop overlapped by said free end, said method comprising:

locating said package on a support table and above said loop with one edge of the strap loop nearer a surface of said package than the other edge of the strap loop;

pressing said free end and an overlapped portion of the strap loop between two opposed restraining members in a region of the overlap below said package to maintain a complete loop at all times with said free end and an overlapped portion in side-by-side surface contact in said region;

twisting said loop about said region to locate the loop around said package;

tensioning said length of strap to tighten the loop about the package; and joining said free end and an overlapped portion in said region.

11. The method of claim 10 including the further step of severing the standing portion of the strap from the tightened and connected loop.

12. A method of tensioning and securing a twisted strap loop located about a package, said strap loop formed between a free end of a length of strap and a standing portion of said length of strap with a portion of the strap loop overlapped by said free end and with a region of the strap free end and adjacent overlapped portion of the loop oriented with one edge of the strap in the region maintained further from a surface of the package than the other edge, said method comprising;

restraining one of said standing portion and said free end while pulling the other to tension said length of strap and thereby tighten the loop about the package; and joining said free end and an overlapped portion in said region.

13. The method of claim 12 wherein the step of restraining includes restraining said free end adjacent, and in sliding contact with, an overlapped portion of the strap loop and wherein the pulling step includes pulling said standing portion whereby an overlapped portion of the strap loop slides along said restrained free end.

* * * * *